United States Patent [19]

Jackson

[11] Patent Number: 4,980,244

[45] Date of Patent: Dec. 25, 1990

[54] PROTECTIVE ALLOY COATINGS COMPRISING CR-A1-RU CONTAINING ONE OR MORE OR Y, FE, NI AND CO.

[75] Inventor: Melvin R. Jackson, Schenectady, N.Y.

[73] Assignee: General Electric Company, Schenectady, N.Y.

[21] Appl. No.: 342,409

[22] Filed: Apr. 24, 1989

Related U.S. Application Data

[63] Continuation of Ser. No. 214,078, Jul. 1, 1988.

[51] Int. Cl.[5] ..... B32B 15/01

[52] U.S. Cl. ..... 428/670; 420/425; 420/462; 428/660

[58] Field of Search ..... 420/428, 462; 428/660, 428/670

[56] References Cited

U.S. PATENT DOCUMENTS 3,817,793 6/1974 Kuhlman et al. ..... 428/428
3,918,139 11/1975 Felten ..... 428/670
4,123,595 10/1978 Chang ..... 428/670
4,371,589 2/1983 Warner et al. ..... 428/661
4,459,263 7/1984 Prasad ..... 420/437
4,477,538 10/1984 Clarke ..... 428/670

FOREIGN PATENT DOCUMENTS 0081666 7/1981 Japan ..... 428/670

OTHER PUBLICATIONS

Wopersnow et al., Metell 33 (Dec. 1979) 1261.
Chakravorty et al. Tour. Mat. Sc. 21 (1986) 2721.

*Primary Examiner*—Upendra Roy
*Attorney, Agent, or Firm*—Paul E. Rochford; James C. Davis, Jr.; James Magee, Jr.

[57] ABSTRACT

Alloy compositions suitable for use in protecting refractory base alloy compositions are disclosed. The coating is formed of an alloy containing chromium, ruthenium and aluminum and which may contain iron, cobalt and nickel. The coating is found to be highly resistant to oxidation.

30 Claims, 4 Drawing Sheets

TRIAXIAL PLOT OF CrRuAl
COMPOSITIONS IN ATOMIC PERCENTAGES

TRIAXIAL PLOT OF CrRuAl
COMPOSITIONS IN ATOMIC PERCENTAGES

PROTECTIVE ALLOY COATINGS COMPRISING CR-A1-RU CONTAINING ONE OR MORE OF Y, FE, NI AND CO.

This application is a continuation of application Ser. No. 214,078, filed July 1, 1988 pending.

The present invention relates generally to improving the resistance of components of jet engines to oxidation and other environmental attacks. More specifically, it relates to a method by which the environmental attack of refractory metal parts in a jet engine is inhibited by coating of the parts and it relates as well to the parts which are formed by the method.

BACKGROUND OF THE INVENTION

It is known that in general jet engines operate at higher efficiency if they operate at higher temperatures. If the operating temperature of a jet engine can be increased by 100° the efficiency of operation of the engine can be significantly improved. Jet engines last more than 10 years in service. If the fuel consumed by a jet engine is reduced by a significant degree over the 10 of more years of expected life of a jet engine, then there is a cost saving in the operation of engine which is very substantial and which permits the engine to be formed at higher costs. The higher engine cost is more than offset by the lower costs of operation of the engine.

The operation of jet engines at higher temperatures also results in a greater thrust-to-weight ratio. In other words, if the same jet engine design is maintained but the materials are altered so that the temperature of operation of the engine is increased then the net result will be that the engine will be found to have a higher thrust-to-weight ratio than the same engine operated at the lower temperature. The materials which are employed in a jet engine which is operated at higher temperature must have greater temperature capability. Alternatively, if materials can be found which operate at the same or higher temperature but which have lower density then a higher thrust-to-weight ratio may be achieved. Further, it is possible to design engines which have material with greater temperature capability and with lower density and this combination also yields engines with greater thrust-to-weight ratios.

Not all of the portions of a jet engine are operated at the same temperature. The portions of the engine which operate at the highest temperature presently operate below 2200° F. The present invention contemplates the modification of the components in the hottest sections of the engines, and particularly of the coatings on the component elements of the hottest sections, so that the component temperature in these sections will operate at temperatures above 2400° F. These temperatures are far greater than encountered in present components. Most materials, such as nickel base alloys, which are presently employed in jet engines are molten at temperatures above 2450–2500° F.

Various metallic systems have been investigated for the hottest components of jet engines to determine the maximum temperature at which they may be employed. The lower density, but lower ductility, ceramic systems are competing with the metallic systems for applications in the hottest components of jet engines. Some of the metallic systems which have been considered include metal matrix composites in which a strengthening component such as a filament is incorporated within a metal matrix. Also low density intermediate phases and intermetallic compounds have been considered for such high temperature applications.

One of the problems which has been associated with the development of metallic systems for high stress capability at high temperatures is that of oxidation of the metallic component at the high temperatures. The choice of metals which can be employed is broadened by the availability of a coating, such as is provided pursuant to the present invention, which will withstand the engine environment.

Presently the nickel base alloys are protected by an alumina-forming metallic coating. Such a coating has a sufficient Al reservoir in the coating to re-form the protective scale when spallation of the oxide from the outer surface occurs. Present iron, cobalt, and nickel base alloys and their alumina-forming metallic coatings are intended for use at lower temperatures below their melting points. The nickel base alloys are not the most reactive metals and in cases where the protective coating is lost the nickel alloy can withstand the engine environment in its uncoated condition for relatively short periods so that loss of the coating for such short periods is not catastrophic to engine performance.

However for a refractory metal or intermetallic system which operates at service temperatures of greater than 2200° F., once a breach of a protective coating is formed the substrate metal may be degraded very rapidly either by oxidation loss of metal cross-section or by environmental embrittlement. For composite systems having a reinforcement element embedded within a matrix metal designed for service at temperatures greater than 2200° F., the large surface area between the matrix and the reinforcement may serve as a rapid diffusion path for such oxidation and/or embrittlement. Accordingly, the demands on a coating and the requirements for a coating on a component to protect the component from the engine environment is much more severe than is the case for the components formed of the nickel base alloys which operate at lower temperatures. One such requirement is that a coating have the capability of rapidly healing of any breach of the protective oxide due to spallation or similar cause so that a "fail-safe" performance of the base metal and coating system may be achieved.

BRIEF STATEMENT OF THE INVENTION

It is accordingly one object of the present invention to provide a coating system for high temperature component parts which permits operation of components formed of the system at temperatures above 2200° F.

Another object is to provide a coating system for a metal base which permits growth of the protective oxide scale under jet engine environmental conditions and particularly high temperature oxidation conditions.

Another object is to provide a coating system which is self-healing at operating temperatures in the range of greater than 2200° F.

Other objects will be in part apparent and in part pointed out in the description which follows.

In one of its broader aspects objects of the invention are achieved by applying a coating having a composition corresponding to one of those enclosed within the envelope A of the accompanying FIG. 5 to a refractory metal substrate.

In one of its narrower aspects, the invention may be achieved by applying a coating having a composition corresponding to one of those enclosed within the smaller envelope B of the accompanying FIG. 5.

In a narrower aspect of the invention, certain modifications may be made to the above composition by substituting other metals for at least part of the ruthenium and/or chromium. Metals which can be substituted for ruthenium in the above composition include iron, nickel and cobalt. The elements iron, nickel and cobalt all have very large solubilities in the hexagonal close packed ruthenium crystal structure, especially at high temperatures. The three elements iron, nickel and cobalt form aluminides of the B2 ordered body centered cubic structure. This is the same structure as the RuAl of the above composition and the solubility of these three substituent metals, iron, nickel and cobalt, in the RuAl aluminide is deemed to be substantial.

In this narrower aspect of the invention, the substituent metals iron, nickel and cobalt are substituted in the above compositions in the place of ruthenium. Also in this narrower aspect, the iron can be substituted to a limited degree for chromium.

Pursuant to this narrower aspect of the invention, iron, nickel and cobalt, either individually or in any combination, can be substituted into the CrRuAl up to about 15 atomic percent for nickel and cobalt and up to 20% for iron.

This composition is written as follows:

$$(Ru_{(19-31x)to(34-x)}(\Sigma Fe+Ni+Co)_xAl_{19to34})\cdot Cr_{(62-y)to(32-y)}Fe_y$$

wherein Σ is a symbol indicating that the sum of the concentrations of the iron, nickel and cobalt present add up to the concentration x in atom percent, and wherein the value of x is between 0 and 15, and wherein the value of y is between 0 and 5 atom percent, and wherein the total value of the expression in atom percent is 100.

In another of its narrower aspects, the compositions of the present invention may be expressed as follows:

$$(Ru_{(22-x)to(28-x)}(\Sigma Fe+Ni+Co)_xAl_{22to28})\cdot Cr_{5.6-y)to(44-y)}Fe_y$$

wherein Σ has the meaning stated above, and wherein x has a value between 0 and 10, and wherein y has a value between 0 and 5, and wherein the total value of the expression in atom percent is 100.

For each of these compositions it is contemplated that minor inclusions of other elements as an impurity will and does occur in the conventional processing of the compositions. It is also contemplated that other elements which do not detract from the properties of the compositions may be included as well.

BRIEF DESCRIPTION OF THE DRAWINGS

The invention and the description thereof which follows will be better understood by reference to the accompanying drawings in which.

DETAILED DESCRIPTION OF THE INVENTION

Figure 1:
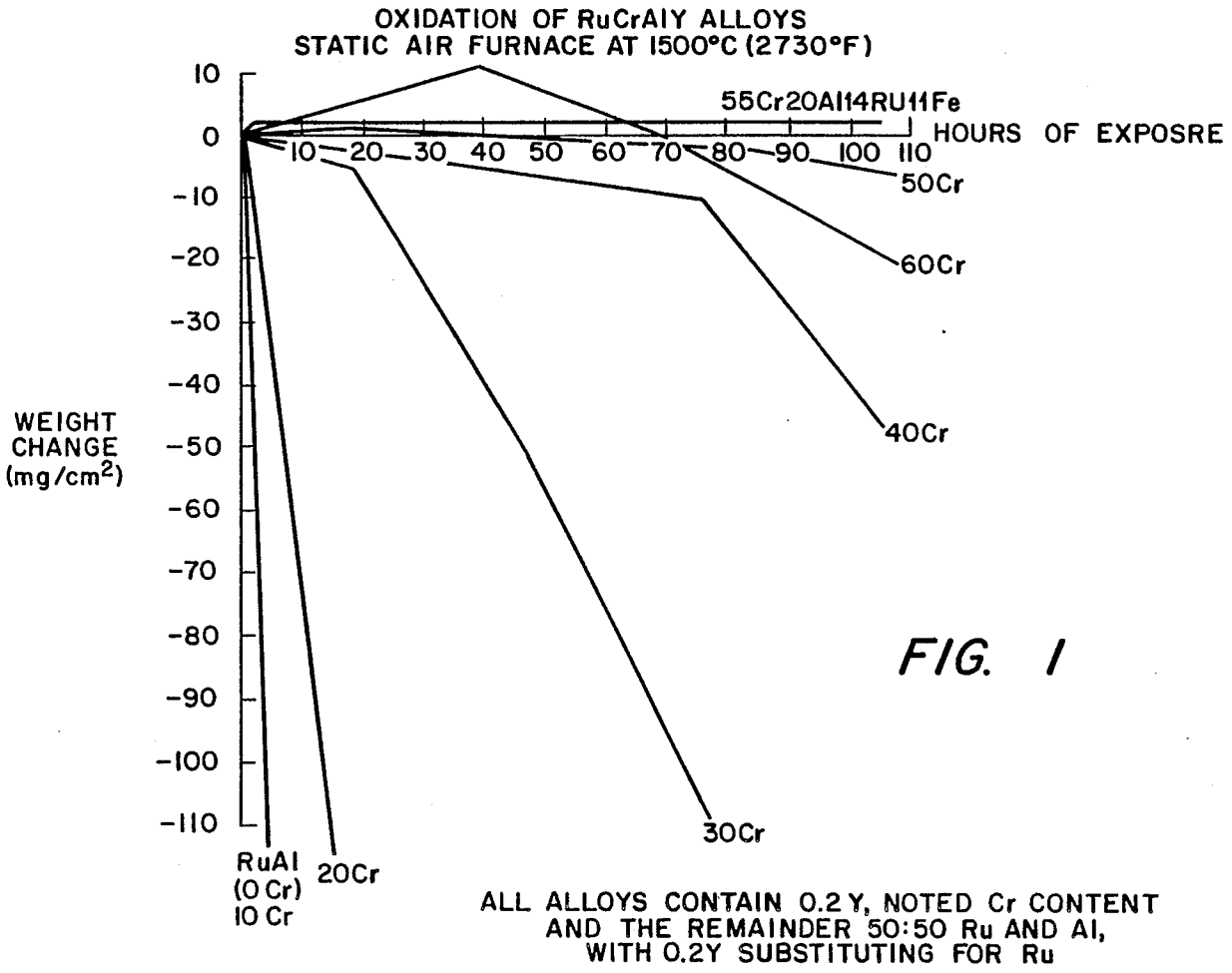
FIG. 1 is a graph in which weight change is plotted against hours of exposure to air at 1500° C. (2730° F.) for a number of alloys with different chromium contents.

What is sought is to form a protective layer on a substrate structural material as a coating which has a relatively low oxidation rate. Stated conversely the material sought is a composition readily adapted to forming a layer which also has relatively high resistance to oxidation. The layer is formed of a chromium base and has a ruthenium aluminum additive.

The material of the substrate on which the layer of the composition of the present invention is to be formed is one which has suitable high temperature properties such as the needed high strength at high temperature, but which does not have sufficiently high resistance to oxidation or similar deteriorating change.

One group of such compositions is the group of refractory metals such as tungsten, molybdenum, niobium and alloys having a refractory metal base. Such metals have good strength at high temperatures but are subject to oxidation attack at a high rate at the high temperatures at which they have good strength.

Another group of compositions having high strength at high temperature are the intermetallic compounds such as titanium aluminide, TiAl, and niobium aluminide, $Al_3Nb$. Such intermetallic compounds are also subject to oxidation at the high temperatures at which these compounds exhibit good strength. The compositions of the present invention have good resistance to oxidation at such high temperatures and can be used as protective coatings on these and other intermetallic compounds.

It is preferred according to the present invention that the substrate metal to be protected have aluminum as one of the ingredients thereof. The aluminides, as for example the aluminides of titanium or niobium, have aluminum as one of their ingredients and are suitable for protection by a layer of the alloy of the present invention as described above. In such case, and where the coated material is to be used at temperatures below about 2300° F., the protective coating of this invention may be applied directly to the substrate material.

Where the substrate does not contain aluminum as an ingredient or where the coated substrate is to be used at temperatures above 2300° F. then it is advisable to employ a barrier coating layer under the protective coating layer as provided pursuant to this invention.

The following examples provide information on the basis of which the composition of the present invention was defined.

EXAMPLE 1

An RuAl alloy was made up to have the composition RuAl+0.2 at.% yttrium. The ruthenium and aluminum components of the composition were in equal atomic percentages. Oxidation resistance studies on this alloy were made by heating the alloy in air for one hour at temperatures of 1400°, 1500° and 1600° C. Weight change measurements were made and the results are listed in Table I below.

TABLE I

| Alloy in atomic % | Weight Change (mg/cm²) after one hour exposure at 1400° C. | 1500° C. | 1600° C. |
|---|---|---|---|
| RuAl 0.2Y (a/o) | −7 | −13 | −22 |

The RuAl composition was spalling oxide at all three temperatures, with spallation at 1600° C. being the worst. The numbers listed under the respective temperatures represent the milligrams per square centimeter of surface area of the sample which was lost during cooling after the heating for one hour.

EXAMPLE 2

An arc melted alloy containing (Ru,Fe)Al was prepared. The (Ru,Fe)Al notation indicates that iron was substituted for ruthenium in the aluminide composition and that the composition was accordingly a combined aluminide of ruthenium and iron. This alloy contains 0.2 at.% yttrium. Substitution of iron for ruthenium was made based on the large mutual solubilities of iron and ruthenium. As noted above, the elements iron, nickel and cobalt all have very large solubilities in the hexagonal close packed ruthenium crystal structure, especially at high temperatures. All four elements form aluminides of the B2 ordered body centered cubic structure, and solubility of each of iron, nickel and cobalt in the ruthenium aluminide (RuAl) is deemed to be substantial. These elements are lower atomic weight than ruthenium, so that alloyed aluminides will be lower in density than is RuAl. The high cost of ruthenium is another reason to consider partial replacement of ruthenium with iron, cobalt or nickel. Again, oxidation resistance studies were made of the (Ru,Fe)Al alloy and the procedure used in Example 1 was repeated so that exposures of the alloy for one hour in air were made for the material at 1400° C., 1500° C. and 1600° C. The weight change measurements and results of these tests are listed in Table II below.

TABLE II

| Alloy in atomic % | Weight change (mg/cm²) after one hour exposure at 1400° C. | 1500° C. | 1600° C. |
|---|---|---|---|
| 33Ru 20Fe 46.8Al 0.2Y | +37 | +62 | +176 |

It was observed that the iron-containing RuAl was spalling very little oxide. However, the very rapid oxidation rate indicates the oxide which did form and which remained on the sample was not protective.

Calculations show that for 300 hours of service life of a 100μm thick coating, where it is assumed there is no interaction with the substrate, a coating of density 7 grams per cubic centimeter can lose the metallic coating at a rate of about 0.23 milligrams per square centimeter per hour to be completely consumed in 300 hours. From this calculation it is clear that the spallation rate of oxide from RuAl is too great for any appreciable service life. Also, the oxidation rate of the (Ru,Fe)Al indicates that a very great depth of material is being consumed by oxidation and that the iron and ruthenium are probably participating in the scale formed.

EXAMPLES 3–6

An effort was made to improve the oxidation resistance of the RuAl base and (Ru,Fe)Al base compositions. For this purpose compositions were made up as set forth in Table III below. Additions of chromium were made to a level where a separate αCr phase was expected. The two alloys can be considered as being similar, with 15% iron replacing 10% ruthenium and 5% chromium. The high solubility of iron in αCr suggested that alloy balance would be maintained by iron substitution for both ruthenium and chromium. In the table the compositions are listed and also the weight changes which are found after one hour exposure at 1400° C., 1500° C. and 1600° C. are listed.

TABLE III

| Example | Alloy in atomic % | Weight change (mg/cm²) after one hour exposure at 1400° C. | 1500° C. | 1600° C. |
|---|---|---|---|---|
| 3 | 40Cr29.8Ru30A10.2Y | +4 | +3 | −1 |
| 4 | 35Cr19.8Ru15Fe3-0A10.2Y | +1 | +2 | −1 |

The conversion of atomic to weight percent for the alloys of examples 3 and 4 are as follows:

| Ingredient | EXAMPLE 3 Atomic % | Weight % | EXAMPLE 4 Atomic % | Weight % |
|---|---|---|---|---|
| Chromium | 40 | 35.1 | 35 | 33.2 |
| Ruthenium | 29.8 | 50.9 | 19.8 | 36.5 |
| Aluminum | 30 | 13.7 | 30 | 14.8 |
| Yttrium | 0.2 | 0.3 | 0.2 | 0.3 |
| Iron | | | 15 | 15.2 |

The results from the oxidation resistance test of the alloys of Table III were deemed to be very favorable. Based on these favorable results additional tests were run at 1600° C. on the same compositions with several cycles varying the temperature to room temperature and back up to the 1600° C. to measure the weight change. The results are tabulated for examples 5 and 6 in Table IV below:

TABLE IV

| Ex. | Alloy | Weight change (mg/cm²) at 1600° C. after exposures of 1.5 h | 65 h | 67 h | 70 h | 73 h | 80h |
|---|---|---|---|---|---|---|---|
| 5 | 40Cr29.8Ru30Al0.2Y | +.5 | +14.4 | +14.8 | +12.2 | +6.5 | +3.8 |
| 6 | 35Cr19.8Ru15Fe30Al0.2Y | +1.6 | +30.6 | +30.6 | +29.1 | +29.3 | +31.1 |

The 80 hour exposures at 1600° C. represent a large fraction of service life for components which would see a maximum temperature of 1600° C. These two materials as listed in Tables III and IV are good candidates for coatings based on these data. Both materials showed evidence of partial liquation at 1650° C. in air so that maximum service temperature would be no more than 1600° C.

EXAMPLES 7–13

A series of alloys having increased chromium was produced in the CrRuAlY materials format as set forth in Table V below. For each alloy the ruthenium and aluminum was reduced as the chromium was increased.

TABLE V

| Example | Nominal Composition of Alloy in Atom Percent | | | |
|---|---|---|---|---|
| 7 | OCr | 49.8Ru | 50Al | 0.2Y |
| 8 | 10Cr | 44.8Ru | 45Al | 0.2Y |
| 9 | 20Cr | 39.8Ru | 40Al | 0.2Y |
| 10 | 30Cr | 34.8Ru | 35Al | 0.2Y |
| 11 | 40Cr | 29.8Ru | 30Al | 0.2Y |
| 12 | 50Cr | 24.8Ru | 25Al | 0.2Y |
| 13 | 60Cr | 19.8Ru | 20Al | 0.2Y |

Samples were exposed to 1500° C. (2730° F.) for times to 105 hours. As is evident from Table V, the alloy chemistries were maintained at approximately 50:50 Ru:Al, with chromium from 0 to 60 a/o at 10 a/o intervals. All alloys contained 0.2 a/o yttrium substituted for 0.2 a/o ruthenium. Results of weight change measurements are shown in FIG. 1. Yttrium may be added in amounts up to 1.0 a/o to enhance adherence of the protective oxide scale. However, for the highest service temperature (≧2300F.) the yttrium content should be held to ≦0.2 a/o in order to avoid liquid phase formation.

Materials which were predominantly βRuAl as in examples 7–9 showed poor performance. Those with substantial chromium, as in Examples 10 and 11, showed much better performance, with the 40–60 a/o chromium of Examples 11–13 alloys being the most oxidation resistant.

The conversion of atomic to weight percent for the test sample alloys of some illustrative examples of this grouping of examples is as follows:

| Ingredient | Example 11 | | Example 13 | |
|---|---|---|---|---|
| | Atomic % | WT. % | Atomic % | WT. % |
| Chromium | 40 | 35.1 | 60 | 54.9 |
| Ruthenium | 29.8 | 50.9 | 19.8 | 35.3 |
| Aluminum | 30 | 13.7 | 20 | 9.5 |
| Yttrium | 0.2 | 0.3 | 0.2 | 0.3 |

Figure 2:
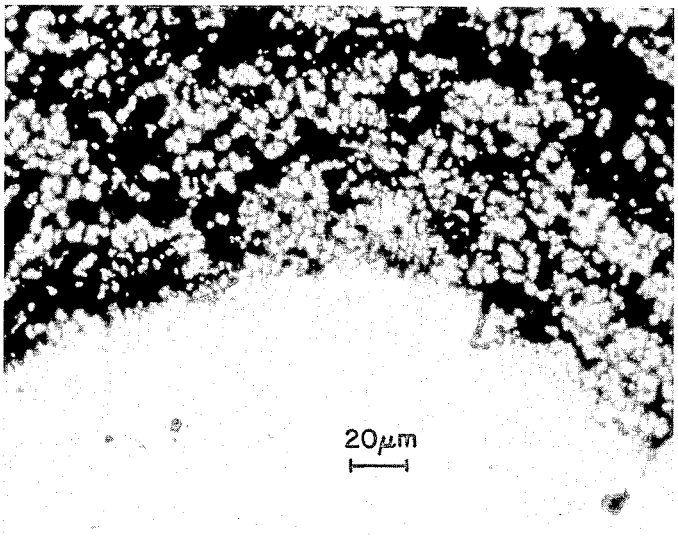
FIG. 2 is a photomicrograph of a section through the surface of the alloy containing 20 atomic percent chromium after oxidation at elevated temperature.

Microstructural studies of low chromium test samples after oxidation indicated, as illustrated in FIG. 2, an oxide at the surface separated from the substrate by a substantial zone of metal+oxide. The metal of the test sample is an εRu solid solution, the remnant of $Al_2O_3$, aluminum oxide, formation depleting the β structure of aluminum.

Figure 3:
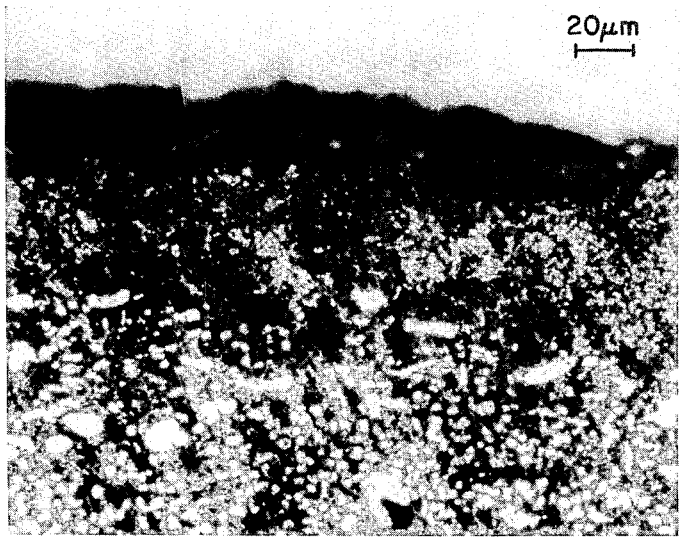
FIG. 3 is a photomicrograph of a section through the oxidized surface of an alloy of this invention.

At higher chromium levels, where a protective, thin scale was formed, the oxide was adjacent to a metallic zone devoid of any RuAl as is evident from FIG. 3. This metallic zone was an αCr solid solution.

Figure 4:
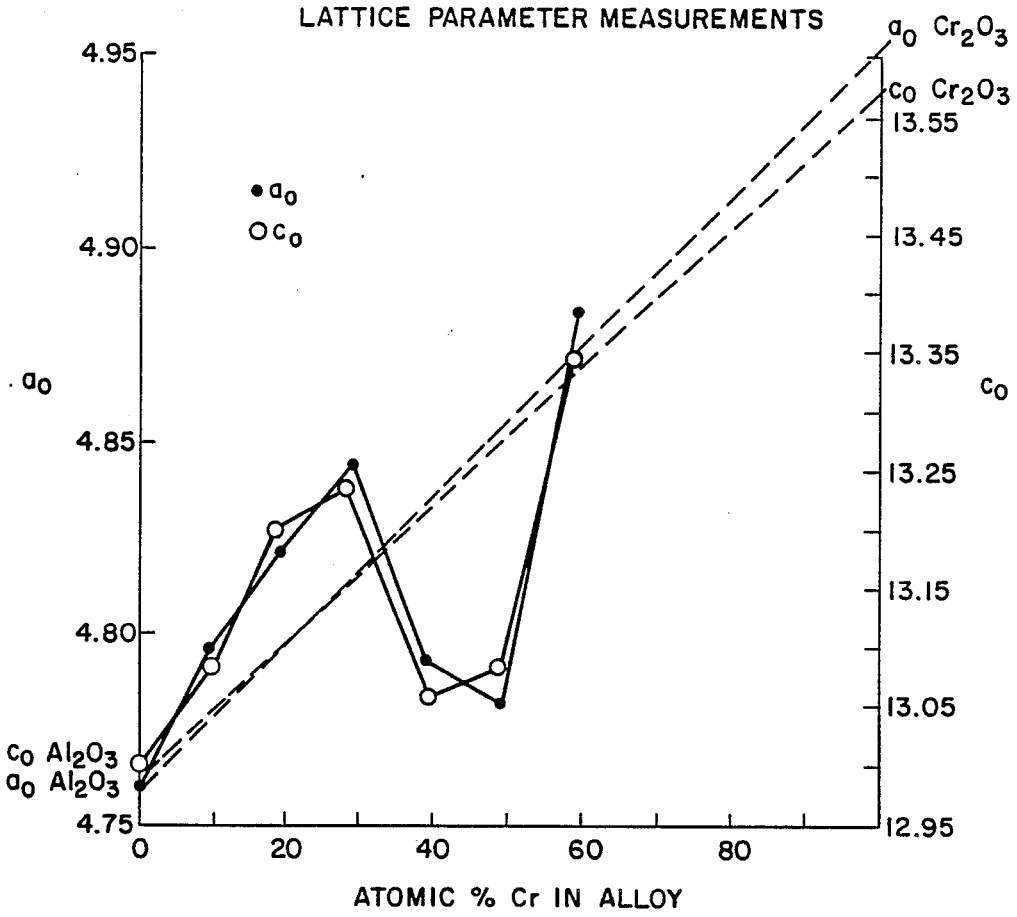
FIG. 4 is a graph of the lattice parameter measurements for a series of alloys formed with different chromium contents in atomic percent.

Lattice parameters measured from oxide scraped from each sample after removal from test are shown in FIG. 4. For alloys with 30 or less atomic percent chromium, these oxides were those present at failure, and represent exposures of 100 or less hours. For oxidation of RuAl, the scale was essentially identical in parameters to corundum-$Al_2O_3$. For alloys of 10–30 atomic percent chromium, the oxide tended to be very similar to that expected from solid solutions of $Al_2O_3$ and chromium oxide, $Cr_2O_3$. FIG. 4 plots lattice parameter measurements, $a_o$ and $c_o$, against the atomic percent chromium in the alloy. $a_o$ is the lattice parameter measurement along the "a" axis and $c_o$ is the lattice parameter measurement along the "c" axis of a unit crystal of the alloys.

For the high chromium materials, the 40 and 50 atomic percent chromium materials of Examples 11 and 12 indicated a relatively pure corundum-$Al_2O_3$ existed on the surface after 105 hours. At 60 atomic percent chromium, although the sample survived the 105 hour test, the oxide on the surface was clearly heavily alloyed.

An interpretation of the data suggests the following model and a description of this model is given here for the assistance that it may provide to those skilled in the art who may seek to practice the invention. In suggesting this model it is not intended to make the accuracy of the invention which is taught or the validity of the claims to the invention dependent on the accuracy of the model.

Although $Al_2O_3$ forms on low chromium CrRuAl alloys, a fine two phase scale forms, containing εRu as well. The interfaces between $Al_2O_3$ and the metal may act as high diffusivity paths for rapid oxidation of aluminum in the substrate.

When sufficient chromium is present so that depletion of aluminum produces an αCr solid solution under the $Al_2O_3$, then a more continuous, protective oxide forms, rather than the two phase structure. Solubility of aluminum in the αCr is high enough to replenish the $Al_2O_3$ layer whenever spalling occurs.

However, when the chromium content is too great, and above about 65 atom percent, the αCr layer under the scale may be so extensive that spallation consumes aluminum in solution before more aluminum can be supplied by the underlying substrate.

As long as a relatively pure $Al_2O_3$ can be maintained as a continuous layer, the system is deemed to be protective. Once chromium begins to play a substantial role in oxide formation, the kinetics of oxide growth and spallation increase, and protective scaling is not maintained.

Figure 5:
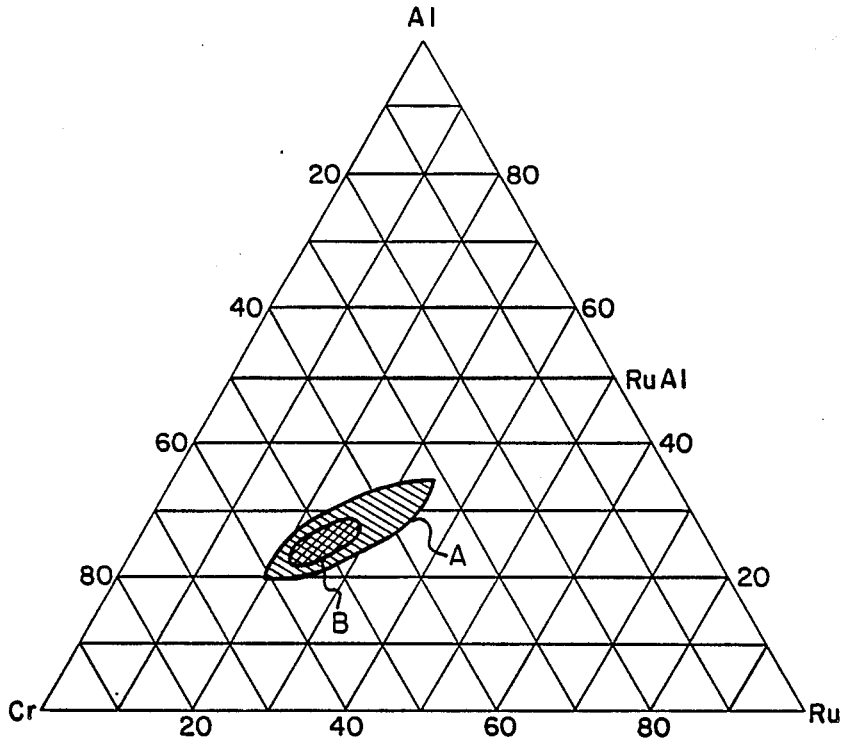
FIG. 5 is a graph of the CrRuAl ternary system showing compositions with oxidation resistance at temperatures as high as 1500° C. (2730° F.).

The compositions of the Cr-Ru-Al base system with very good high temperature oxidation resistance are represented by the compositions in FIG. 5 which reside in the large oval, A. Compositions which retain a relatively greater oxidation resistance for a longer exposure time are those which reside in the smaller oval, B.

EXAMPLE 14

Modifications to these composition ingredient ranges can be made by substituting iron, cobalt and/or nickel in amounts adding up to as much as 15 a/o of any one of the substituents. These substitutions are made in place of ruthenium, resulting in decreased system density and decreased cost, but at the expense of decreased melting point. The substitutions of iron, nickel or cobalt for ruthenium decreases maximum use temperature.

Also because of the high solubility for iron in chromium, a one-for-one replacement of chromium by iron is made equivalent to the ruthenium replacement, up to a maximum of 5 a/o iron replacing 5 a/o chromium. Thus, for iron up to 20 a/o additions can be made replacing up to 15a/o ruthenium and 5% chromium. No similar chromium replacement is available for nickel or cobalt.

As an example of the substitution of metals in the CrRuAl compositions an iron containing alloy was prepared to have the following composition:

TABLE VI

| Example | Nominal Composition of Alloy in Atom Percent | | | | |
|---|---|---|---|---|---|
| 14 | 55Cr | 13.8Ru | 20Al | 6.2Y | 11Fe |

The conversion of atomic to weight percent for the test samples of this example is as follows:

| Ingredient | Example 14 Atomic % | Weight % |
|---|---|---|
| Chromium | 55 | 52.7 |
| Ruthenium | 13.8 | 25.7 |
| Aluminum | 20 | 10 |
| Yttrium | 0.2 | 0.3 |
| Iron | 11 | 11.3 |

The oxidation resistance of this alloy was tested as described with reference to the Examples 7–13 above. The results of the tests are plotted in FIG. 1 above. As is evident from FIG. 1 the results obtained from the test of the iron containing sample show a very slight weight gain at the outset but essentially constant weight with neither a further weight gain nor any appreciable weight loss after that. The oxidation resistance of this iron substituted CrRuAlY after 105 hours at 1500° C. (2730° F.) is accordingly quite remarkable and exceptional.

The present invention makes possible the protection of high strength at high temperature materials which are normally subject to oxidative deterioration at the high temperatures at which the materials display their high strength. Materials such as the refractory metals and intermetallic compounds may be protected in this way.

A number of other substituted alloy compositions may be advantageously employed in similar circumstances.

The base alloy is for example a CrRuAlY having the following composition:

| | | | |
|---|---|---|---|
| 60Cr | +9.8Ru | 20Al | 0.2Y |

By replacing part of the ruthenium with cobalt a composition may be formulated as follows:

| | | | | |
|---|---|---|---|---|
| 60Cr | 16.8Ru | 20Al | 0.2Y | 3.0Co |

By replacing part of the chromium with iron and part of the ruthenium with iron the following compositions can be formulated:

| | | | | |
|---|---|---|---|---|
| 57Cr | 16.8Ru | 20Al | 0.2Y | 6.0Fe |
| 55Cr | 13.8Ru | 20Al | 0.2Y | 11.0Fe |
| 55Cr | 7.8Ru | 20Al | 0.2Y | 17.0Fe |

Numerous other similar compositions can be formulated within the scope of the present invention by substituting nickel, cobalt or iron or any combination of these substituents for ruthenium in the compositions. As indicated above the iron substitutes both for ruthenium and for chromium in the compositions of the present invention.

While the compositions of the present invention are deemed primarily useful as protective and oxidation resistant coatings when used in heavier gauge they may also serve useful structural functions. For coatings or structures greater than about 0.01" in thickness, these compositions may contribute to the load carrying capability of the structure, particularly for structures of total thickness of 0.02" to 0.05".

What is claimed is:

1. A composition consisting essentially of chromium, ruthenium and aluminum in the proportions essentially as set forth within the bounds of curve A of FIG. 5.

2. The composition of claim 1 which contains yttrium in an amount less than 1.0 atom percent.

3. A coating formed on base comprising refractory metals and alloys having the composition of claim 1.

4. A coating formed on base comprising refractory metals and alloys having the composition of claim 2.

5. A composition consisting essentially of chromium, ruthenium and aluminum in the proportions essentially as set forth within the bounds of curve B of FIG. 5.

6. The composition of claim 5 which contains between 0.0 and 0.2 atom percent of yttrium as a substituent for ruthenium.

7. A coating formed on base comprising refractory metals and alloys having the composition of claim 5.

8. A coating formed on base comprising refractory metals and alloys having the composition of claim 6.

9. A refractory metal article, said article being protected from oxidative deterioration by a layer of a composition consisting essentially of chromium, ruthenium and aluminum in the proportions essentially as set forth within the bounds of curve A of FIG. 5.

10. The refractory article of claim 9 in which the composition contains yttrium in an amount less than 0.2 atom percent.

11. A refractory metal article, said article being protected from oxidative deterioration by a layer of a composition consisting essentially of chromium, ruthenium and aluminum in the proportions essentially as set forth in the curve B of FIG. 5.

12. The refractory article of claim 11 in which the composition contains yttrium in an amount less than 0.2 atom percent.

13. A composition consisting essentially of the ingredients in the proportions as set forth in the following expression:

$$(Ru_{(19-x)to(34-x)}(\Sigma Fe+Ni+Co)_x Al_{19to34})\cdot Cr_{(6-2-y)to(32-y)}Fe_y$$

where the symbol Σ indicates that the sum of the concentrations of iron, nickel and cobalt add up to the concentration x in atom percent, and where the value of x is between 0 and 15 atom percent, and where the value of y is between 0 and 5 atom percent, and where the total value of the expression in atom percent is 100.

14. The composition of claim 13 which contains yttrium in a concentration of 0.2 atom percent or less.

15. A coating formed on base comprising refractory metals and alloys having the composition of claim 13.

16. A refractory metal article, said article being protected from oxidative deterioration by a layer of a composition as set forth in claim 13.

17. A coating formed on base comprising refractory metals and alloys having the composition of claim 14.

18. A refractory metal article, said article being protected from oxidative deterioration by a layer of a composition as set forth in claim 14.

19. A composition consisting essentially of the ingredients in the proportions as set forth in the following expression:

$(Ru_{(22-x)to(28-x)}(\Sigma Fe+Ni+Co)_xAl_{22to28})\cdot Cr_{(5-6-y)to(44-y)}Fe_y$ where the symbol Σ indicates the sum of the concentrations of iron, nickel and cobalt and add up to the concentration x in atom percent, and where the value of x is between 0 and 10 in atom percent, and where the value of y is between 0 and 5 in atom percent, and where the total value of the expression in atom percent is 100.

20. The composition of claim 19 which contains yttrium in a concentration of 0.2 atom percent or less.

21. A coating formed on base comprising refractory metals and alloys having the composition of claim 19.

22. A refractory metal article, said article being protected from oxidative deterioration by a layer of a composition as set forth in claim 19.

23. A coating formed on base comprising refractory metals and alloys having the composition of claim 20.

24. A refractory metal article, said article being protected from oxidation deterioration by a layer of a composition as set forth in claim 20.

25. As a composition of matter the alloy consisting essentially of the following composition in atom percent:

| | | | |
|---|---|---|---|
| 55Cr | 20Al | 14Ru | 11Fe. |

26. The composition of claim 25 which contains 0.2 atom percent or less of yttrium as a substituent for ruthenium.

27. A coating formed of the composition of claim 25.

28. A coating formed of the composition of claim 26.

29. A refractory metal article, said article being protected from oxidation deterioration by a layer of an alloy consisting essentially of the following composition in atom percent:

| | | | |
|---|---|---|---|
| 55Cr | 20Al | 14Ru | 11Fe. |

30. The refractory article of claim 29 in which the alloy of the protective layer contains 0.2 atom percent or less of yttrium as a substituent for ruthenium.

* * * * *